US005662029A

United States Patent [19]

Ubert et al.

[11] Patent Number: 5,662,029

[45] Date of Patent: Sep. 2, 1997

[54] HOT AIR OVEN FOR THE PREPARATION OF FOODSTUFFS

[75] Inventors: Harald Ubert, Raesfeld; Joachim Barthel, Reken, both of Germany

[73] Assignee: Ubert Gastrotechnik GmbH, Raesfeld, Germany

[21] Appl. No.: 662,643

[22] Filed: Jun. 10, 1996

[51] Int. Cl.[6] ..... A47J 37/04; A47J 43/18; F24C 7/00; F24C 15/16

[52] U.S. Cl. ..... 99/427; 99/330; 99/357; 99/443 R; 99/450; 99/476; 126/21 A; 219/389; 219/400

[58] Field of Search ..... 99/327–330, 323.5, 99/403–410, 357, 426, 427, 476, 348, 447–450, 443 R, 443 C, 483; 126/21 A; 34/186; 219/400, 389, 388, 506, 348; 426/232, 520, 523

[56] References Cited

U.S. PATENT DOCUMENTS

| | | | |
|---|---|---|---|
| 4,374,318 | 2/1983 | Gilliom | 219/400 |
| 4,491,065 | 1/1985 | Poulson | 99/327 |
| 5,097,754 | 3/1992 | Covington et al. | 99/357 |
| 5,134,927 | 8/1992 | McCarthy, III et al. | 126/21 A |
| 5,148,737 | 9/1992 | Poulson | 99/450 X |
| 5,154,940 | 10/1992 | Budzyna et al. | 426/232 |
| 5,193,444 | 3/1993 | Bar-Sheshet | 99/427 |
| 5,203,253 | 4/1993 | Covington et al. | 99/476 X |
| 5,275,092 | 1/1994 | Fauteux | 99/407 |
| 5,285,719 | 2/1994 | McFadden et al. | 219/400 X |
| 5,339,726 | 8/1994 | Poulson | 99/427 X |
| 5,419,239 | 5/1995 | Covington et al. | 99/357 |
| 5,445,073 | 8/1995 | Gilwood | 99/427 |

FOREIGN PATENT DOCUMENTS

| | | |
|---|---|---|
| 0 143 066-A1 | 5/1985 | European Pat. Off. . |
| 35 08 747-A1 | 9/1985 | Germany . |
| 38 339 657-A1 | 5/1990 | Germany . |
| 39 31 483-A1 | 4/1991 | Germany . |
| 92 01 451-U1 | 4/1992 | Germany . |
| 630 240-A5 | 6/1982 | Switzerland . |
| 1088663 | 10/1967 | United Kingdom . |
| 93-18349-A1 | 9/1993 | WIPO . |

*Primary Examiner*—Timothy F. Simone
*Attorney, Agent, or Firm*—Milton Oliver

[57] ABSTRACT

The invention relates to a hot air oven for the preparation of foodstuffs, having: a casing; a refining chamber bounded by four side walls, a bottom wall and a cover wall; a first fan for producing a hot air flow in the refining chamber; a rotatable basket for the foodstuffs which can be introduced into the refining chamber and through which the hot air flow passes during operation; a control device for the performance of the refining process, said control device comprising a temperature-regulating system; and at least one air supply channel and at least one air discharge channel, a more reliable and low-maintenance operation of which is made possible by the provision of at least one flap to open or close the air supply channel and/or the air discharge channel.

15 Claims, 3 Drawing Sheets

HOT AIR OVEN FOR THE PREPARATION OF FOODSTUFFS

FIELD OF THE INVENTION

The invention relates to a hot air oven for the preparation of foodstuffs.

BACKGROUND

PCT/SE Application 93/00204 discloses a hot air oven for the preparation of foodstuffs wherein deep-cooled foodstuffs such as, for example, chipped potatoes, can be introduced in a wire basket into a refining chamber in which they are at first refined in hot air without air exchange. In this phase the refining chamber is closed, so that the moisture escaping from the foodstuff ensures a hot steam atmosphere in the refining chamber. When the foodstuff has been completely refined, an air supply channel and an air discharge channel are opened via slides, so that the moist atmosphere can escape from the refining chamber and a dry, hot atmosphere regenerated instead. In this phase, also known as the roasting phase, the foodstuff acquires the browning necessary for the vision and the senses.

It has been found in practice with the prior art hot air ovens that it is a problem to open and close the air supply and air discharge channels by means of slides, since the slides must be cleaned relatively frequently, as they tend to become sticky due to the grease-containing atmosphere in the refining chamber.

SUMMARY OF THE INVENTION

It is therefore an object of the invention so to improve a hot air oven that the air supply and air discharge channels can be more reliably controlled with less maintenance.

Since at least one flap is provided to open or close the air supply and/or air discharge channel, there is no risk that the control elements may become sticky. In contrast to slides, in which the surface adjacent the refining chamber is dirtied by splashes of fat and possibly particles, and can then be pulled by the slide guide only with difficulty during actuation, a flap according to the invention can be opened and closed in a problem-free manner even if the side adjacent the refining chamber is considerably dirtied. The surfaces of the flap which contact the sealing elements are appreciably smaller than the corresponding surfaces of a slide.

Also advantageously a heating device for the supplied air is associated with the at least one air supply channel. As a result, during the transition from the steam phase to the roasting phase, preheated air can penetrate into the refining chamber, thus preventing a drop in temperature in the transition from one phase to the next, something which has a positive effect on the duration of the preparation process.

The flap can be controlled by an automated system if the flap can be actuated in dependence on the control device.

The production of the air supply and air discharge channels is facilitated if they are rectangular in cross-section, in which case the flaps are also simple to produce, and simple geometrical relations are present.

Preferably the air discharge channel discharges into an air discharge connection disposed in the zone of the casing, so that the hot moist air escaping after the end of the steam phase can be directly removed.

A cooling outer of the hot air oven is advantageous and rendered possible by the feature that a gap is formed between the casing and the refining chamber. If the air supply channel partially extends through said gap, the air supply can on the one hand be used for cooling the casing, while on the other hand it is already preheated before entering the refining chamber. As a result, the power required for the aforementioned heating device for the air supply is reduced.

If the air supply channel and the air discharge channel are connected to the refining chamber via a number of openings, a more rapid and uniform exchange is made possible of the atmospheres present in the refining chamber. This feature would also have a favourable effect on reducing the preparation time.

Also advantageously a flap is not associated with each opening, so that the flap control system is kept simple.

If the basket is rectangular is cross-section in a plane perpendicular to the axis of rotation and has rounded corners the result is an advantageous movement of the foodstuffs situated in the basket during the preparation time. Advantageously the corners of the basket have a radius of curvature of 5 mm to 60 mm. With a smaller radius of curvature of the corners there is the risk that during the preparation of chipped potatoes they will partly break, something which is undesirable for reasons of appearance. If the radius of curvature of the corners is made larger or the basket is constructed, for example, round, the chipped potatoes do not move sufficiently during their preparation in the hot air oven.

In dependence on the conditions of incorporation of the hot air oven in the kitchen, the basket can be disposed on the left-hand or right-hand or front side of the hot air oven.

BRIEF FIGURE DESCRIPTION

A preferred embodiment of the hot air oven according to the invention is illustrated in the drawings, which show:

FIG. 1 a diagrammatic lateral view in cross-section of a hot air oven according to the invention;

FIG. 2 the hot air oven illustrated in FIG. 1 with the air supply and air discharge flaps opened, and FIG. 3 flap actuation in the hot air oven shown in FIG. 1.

FIG. 1 shows a hot air oven 1.

DETAILED DESCRIPTION

Figure 1:
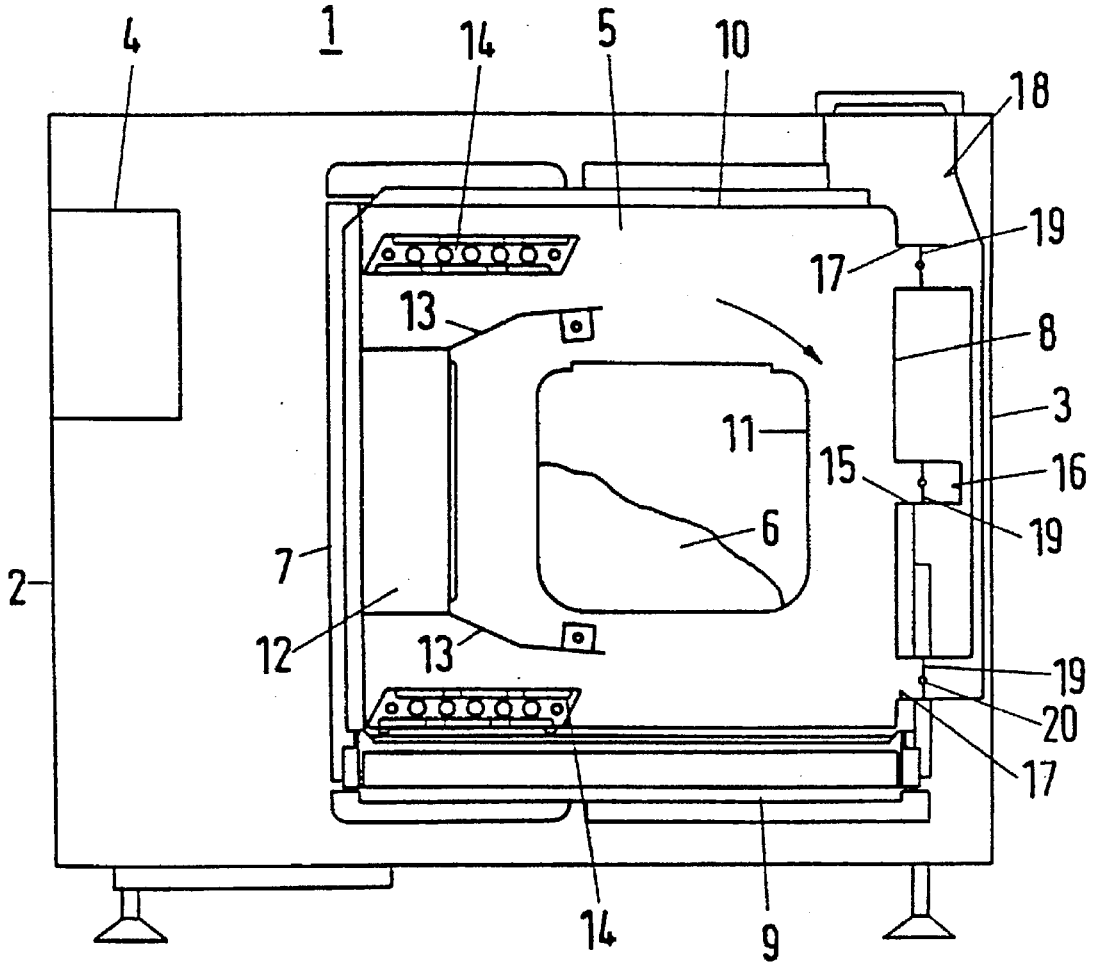

The hot air oven 1 is shown in lateral cross-section, so that its front side 2 is shown on the left and its rear side 3 on the right in the drawings. Disposed on the front side 2 at a place 4 is an operating unit (merely indicated) which is accessible from the front side.

Provided inside the casing is a refining chamber 5 in which foodstuffs 6 in general, more particularly deep-frozen chipped potatoes can be prepared. The refining chamber 5 is bound by a front side wall 7, a rear side wall 8, a bottom wall 9 is a cover wall 10. Disposed in the refining chamber 5 is a basket 11 which is shown substantially square in FIG. 1. The basket 11 is disposed to rotate around an axis standing perpendicular to the plane of FIG. 1.

Also provided in the refining chamber 5 are a hot air fan 12, an air deflector 13 and four heating elements 14. In the zone of the rear wall 8 the hot air oven 1 is formed with a number of openings 15 for connecting the refining chamber 5 to an air supply channel 16, and also a number of openings 17 for connecting the refining chamber 5 to a discharge air channel 18. The openings 15 and 17 are each connected via a flap 19 to the respective air supply/air discharge channel, in which the flaps 19 are rotated through 90° around a central axis 20 standing perpendicularly to the plane of FIG. 1, so that they open the cross-section of the channels 15; 17.

Figure 2:
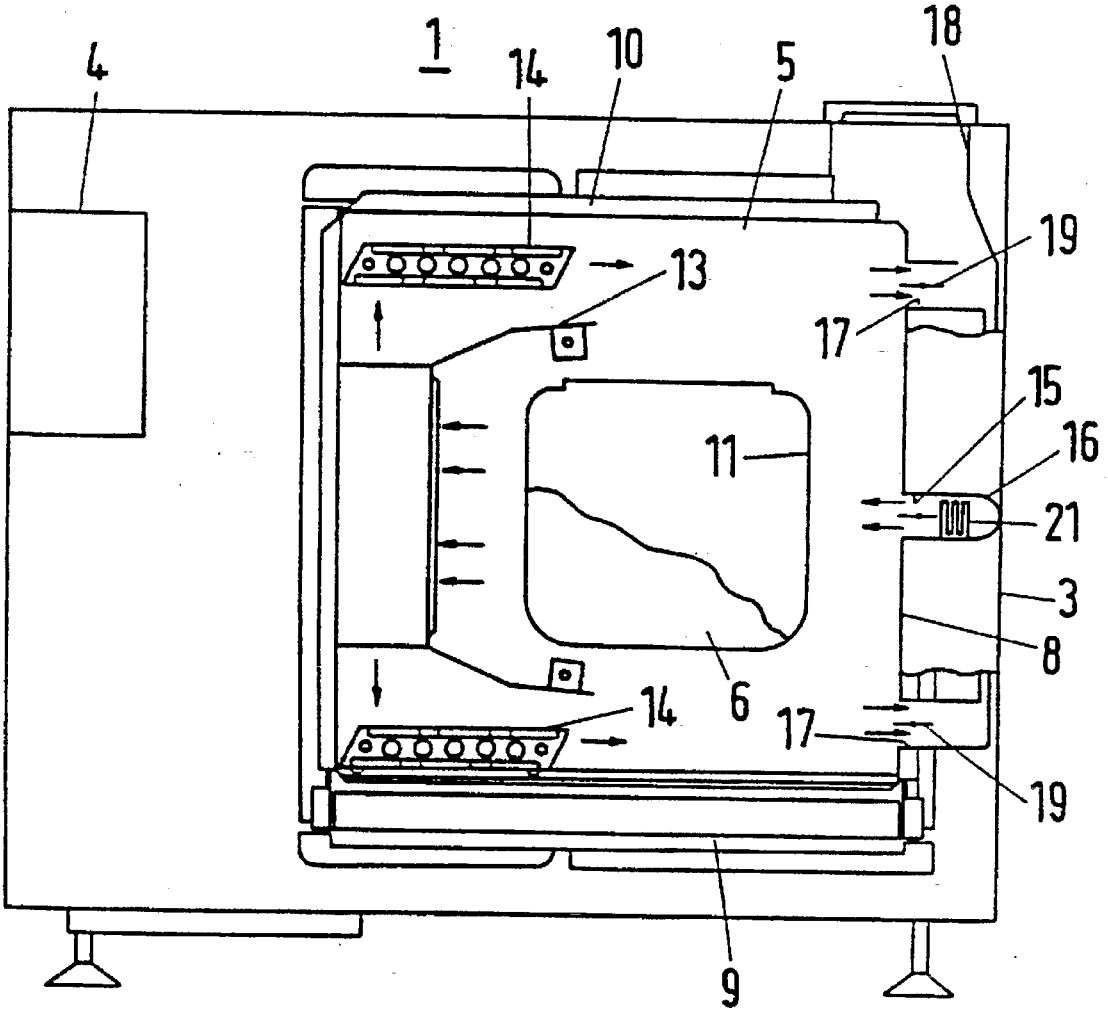

In FIG. 2 the hot air oven shown in FIG. 1 is illustrated in a position with the flaps 19 opened.

In this position of the flaps 19, the refining chamber 5 is connected to the air supply channel 16 and also the air discharge channel 18 via the openings 15 and 17 respectively.

When used for the preparation of foods, more particularly deep-frozen chipped potatoes, the oven is operated as follows:

First the operating personnel switch the apparatus on via the operating unit 4. With the flaps 19 closed, the heating 14 for the apparatus and also the hot air fan 12 are then set in operation, and the refining chamber 5 of the hot air oven 1 is heated to a required temperature, for example, 230° C. for the preparation of chipped potatoes.

When the required temperature has been reached, the apparatus is ready for operation, and a predetermined quantity of the foodstuff 6 to be prepared can be introduced into the basket 11 (shown merely diagrammatically in FIGS. 1 and 2). For this purpose the basket is withdrawn from the refining chamber 5 in the direction of its axis of rotation—i.e., in a direction perpendicular to the plane of FIGS. 1 and 2. When the foodstuff 6 has been introduced into the basket 11, the basket is again pushed back into the refining chamber 5 parallel with the axis of rotation, so that the foodstuff 6 is completely situated in the refining chamber and the refining chamber 5 is closed off from the exterior. The hot air fan 12 is then brought up to nominal speed and sucks in air from the direction of the basket 11 through a portion of the air deflector 13 disposed immediately alongside the fan 12. The air is blown in the radial direction of the fan 12 over the heating elements 14, which are switched on at this point, since the temperature in the refining chamber drops with the foodstuffs freshly introduced. The basket 11 also rotates around the axis—i.e., clockwise as shown in FIGS. 1 and 2. With the flaps 19 closed, air flow as shown in FIG. 1 passes from the fan upwards and downwards over the heating elements 14 and, guided by the air deflector 13, parallel with the cover wall 10 and the bottom wall 9. From there the air flow moves in the direction of the basket 11 and passes through the foodstuff 6, which is continuously mixed due to the rotation of the basket 11. Air flow passing through the foodstuff 6 heats the foodstuff uniformly and is cooled when it re-enters the fan 12 through the cutaway portion of the deflector 13. Moisture escapes during the heating of the foodstuff situated in the refining chamber, thus setting up in combination with the rising temperature a moist hot atmosphere in which the foodstuff 6 is refined. When the foodstuff 6 has been heated to the core, the flaps 19 are opened, and a fan blows fresh air via the air supply channel 16 and the openings 15 in the direction of the basket 11. The hot moist atmosphere can escape from the refining chamber to the air discharge channel 18 via the openings 17. Advantageously the heating register is provided in the air supply channel to prevent any drop in the temperature of the refining chamber 5 of the hot air oven 1 during this phase of the preparation process. The air supplied can then be heated to the required value of 230° C., so that the exchange of atmosphere in the refining chamber can be completed without a reduction in temperature. This also enhances the quality of the foodstuff.

When the moisture escaping from the foodstuff has been removed from the refining chamber 5, the roasting phase if the preparation process begins, during which the refined foodstuff is given the browning which improves its taste and makes it crisp. The roasting phase takes place in a dry hot atmosphere.

When the roasting process has been completed—i.e., when the foodstuff 6 has attained the required consistency—, the heating elements 14 are switched off and the operating unit 4 delivers a signal indicating to the operating personnel that the foodstuff 6 can be removed. For this purpose the basket 11 is again withdrawn from the apparatus and emptied by being rotated through 360°.

In the apparatus described hereinbefore the advantages according to the invention are obtained due to the feature that the flaps 19 for opening and closing the openings 15; 17 do not run through a guide, as in the prior art slide constructions, but are rotated freely in the channel. The splashes of fat inevitably occurring during the roasting phase of the preparation process can be deposited on the side of the flaps 19 adjacent the refining chamber 5, without adverse effect on the operation of the flaps. Moreover, the flaps 19 can be simply actuated via a common linkage.

Figure 3:
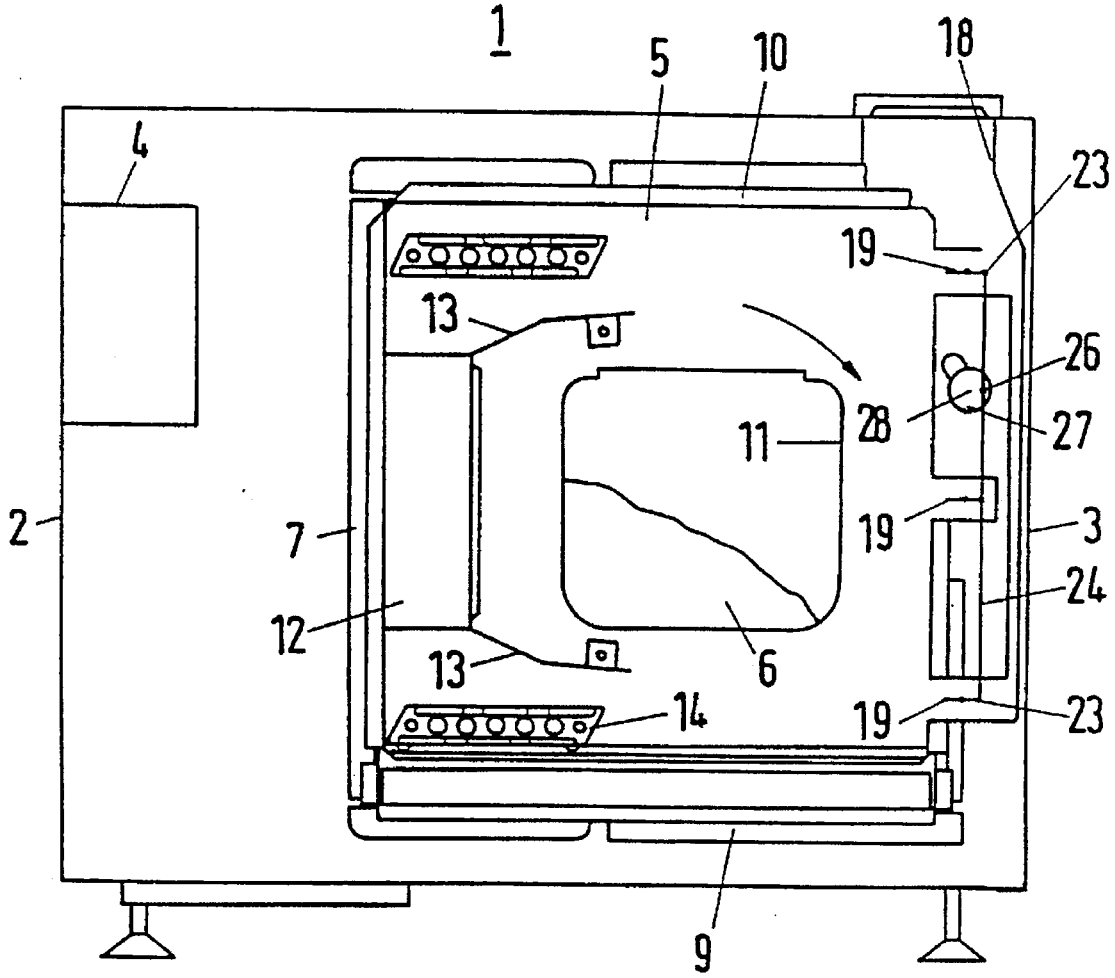

Such a linkage is shown in FIG. 3. At their end remote from the refining chamber 5 the flaps 19 each have a bearing pin 23 which is rotatably mounted in a connecting rod 24. The connecting rod 24 is attached by means of a bearing pin 26 to a control disc 27. The control disc 27 is attached to an adjusting motor (not shown) and rotates around the axis 28 when the motor is started.

When the adjusting motor rotates the disc 27 by a predetermined angle clockwise or anticlockwise, the flaps 19 are rotated around their axes by the same angle. If the flaps 19 have a length corresponding to the height of the openings, a rotation through 90° is required for the complete closure of the flaps. If the flaps 19 are longer than what corresponds to the height of the opening, a complete closure of the openings is ensured by a smaller pivoting movement. The last-mentioned construction is to be preferred, since in that case no dead centre occurs in the actuation of the flaps and the control discs.

All of the flaps can therefore be simultaneously moved in synchronism by means of one adjusting member.

Particularly advantageously a row of openings for the air supply and air discharge is provided parallel with the axis of rotation of the basket 11. Such a row of channels is not shown in FIG. 3. It would extend perpendicularly to the plane of the drawing. The row of openings should have substantially the same length as the basket 11, so that the preheated air supply can be blown directly on to the foodstuff 6 over the entire width of the basket 11. The air discharge channels should also be distributed over the full depth of the refining chamber 5, thus ensuring that the moist hot atmosphere is rapidly removed on completion of the steam phase.

Lastly, it makes sense to connect the air discharge channel 18 to a ventilating flue extending out of the room in which the hot air oven is set up, so that the blown-out air cannot enter the room.

What is claimed is:

1. A hot air oven for the preparation of foodstuffs, having a casing:

a refining chamber (5) bounded by four side walls (7, 8), a bottom wall (9) and a cover wall (10);

a first fan (12) for producing a hot air flow in the refining chamber (5);

a rotatable basket (11) for the foodstuffs (6) which can be introduced into the refining chamber (5) and through which the hot air flow passes during operation;

a control device (4) for the performance of the refining process, said control device (4) comprising a temperature-regulating system;

and at least one air supply channel (16) and at least one air discharge channel (18), characterized in that at least one flap (19) is provided to open or close the air supply channel (16) and/or the air discharge channel (18).

2. A hot air oven according to claim 1, characterized in that a heating device (21) for the supplied air is associated with the at least one air supply channel (16).

3. A hot air oven according to claim 1, characterized in that the flap (19) can be actuated in dependence on the control device (4).

4. A hot air oven according to claim 1, characterized in that the air supply channel and/or the air discharge channel (18) are substantially rectangular in cross-section.

5. A hot air oven according to claim 1, characterized in that the air discharge channel (18) discharges into an air discharge connection disposed in the zone of the casing.

6. A hot air oven according to claim 1, characterized in that a gap is formed between the casing and the refining chamber (5).

7. A hot air oven according to claim 6, characterized in that the air supply channel (16) partially extends through the gap.

8. A hot air oven according to claim 1, characterized in that the air supply channel (16) and the air discharge channel (18) are connected to the refining chamber (5) via a number of openings (15, 17).

9. A hot air oven according to claim 1, characterized in that only one common adjusting member (28) is provided for the actuation of all the flaps (19).

10. A hot air oven according to claim 1, characterized in that the flaps (19) have a laterally disposed shaft, so that the flaps can be pivoted in a zone remote from the refining chamber (5).

11. A hot air oven according to claim 1, characterized in that the basket (11) is rectangular in cross-section in a plane perpendicular to the axis of rotation and has rounded corners.

12. A hot air oven according to claim 1, characterized in that the corners of the basket have a radius of curvature of 5 mm to 60 mm.

13. A hot air oven according to claim 1, characterized in that the basket (11) is disposed for insertion on the front side of the hot air oven.

14. A hot air oven according to claim 1, characterized in that the basket (11) is disposed for introduction on the left-hand side of the hot air oven.

15. A hot air oven according to claim 1, characterized in that the basket (11) is disposed for insertion on the right-hand side of the hot air oven.

* * * * *